US005505798A

United States Patent [19]

Nelson

[11] Patent Number: 5,505,798

[45] Date of Patent: Apr. 9, 1996

[54] METHOD OF PRODUCING A TOOL OR DIE STEEL

[75] Inventor: Jerry L. Nelson, 42567 Eldon Ave., Clinton Township, Mich. 48038

[73] Assignee: Jerry L. Nelson, Clinton Township, Mich.

[21] Appl. No.: 264,135

[22] Filed: Jun. 22, 1994

[51] Int. Cl.[6] ..... C21D 9/00

[52] U.S. Cl. ..... 148/663; 148/579

[58] Field of Search ..... 148/663, 579, 148/333

[56] References Cited

U.S. PATENT DOCUMENTS

| | | | |
|---|---|---|---|
| 3,615,905 | 10/1971 | Omsen et al. | 148/12.4 |
| 3,660,174 | 5/1972 | Jakenberg | 148/12 |
| 3,834,951 | 9/1974 | Jakenberg | 148/36 |
| 3,867,135 | 2/1975 | Johnsson et al. | 75/60 |
| 3,888,956 | 6/1975 | Klint | 264/5 |
| 3,898,079 | 8/1975 | Eriksson | 75/60 |
| 3,918,692 | 11/1975 | Öberg | 266/35 |
| 3,942,978 | 3/1976 | Öberg et al. | 75/51 |
| 4,046,598 | 9/1977 | Janzon | 148/12 R |
| 4,115,111 | 9/1978 | Itoh et al. | 75/128 P |
| 4,236,096 | 11/1980 | Tiemann | 313/1 |
| 4,236,920 | 12/1980 | Lampe et al. | 75/128 A |
| 4,276,085 | 6/1981 | Wisell | 75/126 C |
| 4,428,781 | 1/1984 | Norström | 148/36 |
| 4,673,433 | 6/1987 | Roberts | 75/53 |
| 4,765,849 | 8/1988 | Roberts | 148/335 |
| 4,863,515 | 9/1989 | Roberts et al. | 75/238 |
| 5,055,253 | 10/1991 | Nelson | 420/87 |
| 5,182,079 | 1/1993 | Nelson | 420/87 |

FOREIGN PATENT DOCUMENTS

| | | | |
|---|---|---|---|
| 55-89426 | 7/1980 | Japan | 148/663 |
| 432224 | 11/1974 | U.S.S.R. . | |
| 592866 | 2/1987 | U.S.S.R. . | |

OTHER PUBLICATIONS

M. R. Krishnadev et al. "Copper–Boron Low Alloy High Strength Steels," pp. 195–200, Pagamon Press 1983.

R. A. Grange et al., "Effect Of Copper On The Heat Treating Characteristics Of Medium–Carbon Steel," Transactions of the ASM, vol. 51, pp. 377–393, copyright 1958.

"The Making, Shaping And Treating of Steel," Edited By Harold E. McGannon, United States Steel, Ninth Edition, copyright 1971, Chapters 2, 43, 44, 46, 47, 48 and 51.

American Society for Metals, "Tool Steels," Fourth Edition, copyright 1980, pp. 227–250.

"Guide To Tooling Materials," Penton Publishing, Inc., Revised Edition 1987, pp. 3–46.

American Society For Metals, "Heat Treater's Guide, Standard Practices And Procedures For Steel," copyright 1982, pp. 450–451.

*Primary Examiner*—Deborah Yee

*Attorney, Agent, or Firm*—Rankin, Hill, Lewis & Clark

[57] ABSTRACT

The invention provides a novel metallic composition and method of using the same. More particularly, the invention affords a tool steel and a method of heat treating the tool steel. In one of the preferred embodiments the tool steel includes about 0.50 to about 0.65 percent by weight carbon, about 0.095 to about 1.70 percent by weight manganese, up to about 0.030 percent by weight phosphorus, about 0.095 to about 0.200 percent by weight sulfur, about 1.10 to about 1.90 percent by weight chromium, about 0.10 to about 0.50 percent by weight nickel and about 0.20 to about 0.60 percent by weight copper. The tool steel of the present invention is preferably heat treated utilizing a heat treatment schedule that includes the steps of a preheat, austenization and a double temper.

15 Claims, 1 Drawing Sheet

METHOD OF PRODUCING A TOOL OR DIE STEEL

FIELD OF INVENTION

The present invention concerns a metallic composition and a method of using the same. More particularly, the invention concerns a tool steel and a method of using the tool steel to produce tools, dies or similar items.

BACKGROUND

The prior art provides various tool steels for use in producing items such as tools and dies. Such tool steels are generally classified as: (i) relatively low-alloy tool steels having higher hardenability than plain carbon steels; (ii) intermediate alloy steels which usually contain elements such as tungsten, molybdenum or vanadium, which form hard, wear resisting carbides; and (iii) high-speed tool steels containing large amounts of carbide forming=elements which serve not only to furnish wear resisting carbides but also to promote secondary hardening and thereby increase resistance to softening at elevated temperatures.

The relatively low-alloy and intermediate tool steels are commonly employed to produce dies which are utilized to shape, form, bend, draw, cut or otherwise process low carbon steels, stainless steels and aluminum. Such materials prior to processing may assume any one of a variety of configurations such as, for example, bars, rods, strips or sheets. The automotive industry, which does a considerable amount of metal processing, utilizes various low-alloy and intermediate alloy tool steels to produce dies. Such dies are commonly employed in presses and are used to produce items such as, for example, hoods, fenders, roof decks and trunk lids. The automotive industry places some fairly critical demands upon the tool steels from which their dies are produced. More particularly, many automotive dies undergo a considerable amount of machining and grinding in order to allow the die to produce items of intricate shape and exacting size tolerances. Also, automotive dies are many times used to process a tremendous number of items and are thus subject to very long runs. Additionally, some automotive dies are very large in size and require a considerable amount of tool steel in their production. Thus, preferably the tool steel does not include major amounts of expensive alloying elements because the cost of the tool steel itself can be a significant factor in the construction of the dies.

An example of one tool steel utilized by the automotive industry to produce dies is a tool steel sold by the Uddeholm Corporation of Sterling Heights, Mich., under the trademark FERMO. Generally, FERMO tool steel would be classified as a relatively low-alloy tool steel having about 0.45 to 0.52 percent by weight carbon, 0.75 to 1.05 percent by weight manganese, 0.40 to 0.80 percent by weight silicon and 1.30 to 1.70 percent by weight chromium. FERMO tool steel is preferred by some automotive personnel because it tends not to distort during flame hardening. Also, FERMO tool steel may be welded cold thereby facilitating repair of the die while it is mounted in the press or similar machine. Thus, such dies do not have to be removed from the press thereby helping to minimize costly downtime. Unfortunately, FERMO tool steels generally display a maximum Rockwell (R) hardness on the C-scale (Rc) of about 54 to 58. Thus, FERMO tool steel is generally not suited for long runs where a die is scheduled to be utilized to produce a great number of items or pieces.

An example of another tool steel utilized by the automotive industry includes about 0.85 to 1.0 percent by weight carbon, .20 to 0.30 percent manganese, 0.20 to 0.30 percent by weight silicon and 0.15 to 0.25 percent by weight vanadium. This tool steel is preferred by some automotive personnel because it can be repair welded in the press. However, flame hardening of this tool steel is conducted at a temperature of about 1600° F. to 1650° F. followed by a water quench. Unfortunately, distortion has been found many times to develop during this hardening treatment.

An example of another tool steel utilized by the automotive industry includes about 0.85 to 1.10 percent by weight carbon, 0.50 to 0.70 percent by weight manganese, 0.25 to 0.40 percent by weight silicon, 4.75 to 5.25 percent by weight chromium, 0.20 to 0.40 percent by weight vanadium and 0.95 to 1.20 percent by weight molybdenum. This tool steel is commonly flame hardened at a temperature of about 1800° F. or higher and generally displays a Rockwell hardness on the C-scale of around 60. This tool steel usually cannot be repair welded while the die is in the press. Generally, the damaged die, or sections thereof, must be removed from the press and preheated prior to repair welding. This can be a time-consuming process leading to costly downtime.

Another tool steel utilized in the automotive industry includes about 0.45 to 0.55 percent by weight carbon, 1.0 to 1.20 percent by weight manganese, 0.30 to 0.50 percent by weight silicon, 1.00 to 1.25 percent by weight chromium and 0.35 to 0.45 percent by weight molybdenum. This alloy is generally supplied in an annealed condition having a Brinell hardness number (BHN) of about 180 to 220. Flame hardening of this tool steel is generally conducted at a temperature of about 1780° F. followed by a water quench to produce a Rockwell hardness on the C-scale of about 58 to 60. Problems experienced by some automotive personnel with this tool steel include distortion during flame hardening and a relatively low wear resistance.

Generally, the aforementioned steels are formed into dies while the tool steel is in an annealed and/or normalized condition. In order to attain this condition, such tool steels are generally annealed and/or subjected to a normalization treatment until the desired hardness is attained.

Relatively low alloy tool steels are also used in some applications to produce tools such as chisels. An example of a tool steel that was at one time utilized to produce chisels contained about 0.35 percent by weight carbon, 0.70 percent by weight manganese, 0.45 percent by weight silicon, 0.80 percent by weight chromium, 0.30 percent by weight molybdenum and 0.30 percent by weight copper. This tool steel was preferred for such applications as chisels because of its tendency not to become brittle and break during use. This tool steel generally would not be used to produce dies because of its inability to consistently produce Rockwell hardnesses on the C-scale in excess of about 54.

A recently developed flame hardenable tool steel and methods of heat treating such steel are disclosed in U.S. Pat. Nos. 5,182,079 and 5,055,253. These patents disclose a tool steel comprising by weight 0.50–0.65 percent carbon, 0.090–1.45 percent manganese, up to about 0.030 percent phosphorus, 0.035–0.070 percent sulfur, 1.10–1.90 percent chromium, 0.15–0.40 percent nickel and 0.20–0.40 percent copper. The '079 patent discloses two different heat treat schedules. One schedule concerns castings over 120 pounds and the other schedule concerns castings below 120 pounds. Generally, for castings below 120 pounds the tool steel is preheated, austenitized and double tempered. For castings above 120 pounds the tool steel is normalized followed by air-cooling.

SUMMARY OF INVENTION

The present invention provides a new and improved metallic composition. More particularly, the present invention provides a novel relatively low-alloy tool steel for use in producing tools, dies and other similar items. The tool steel is particularly well suited for use in producing dies for the automotive industry.

The tool steel affords various distinct advantages over many prior art tool steels. Specifically, the tool steel of the present invention may be flame hardened by a user with virtually no distortion. This allows an end user to finish machine and grind the die in a soft (i.e., pre-hardened) condition and flame harden the die while it is mounted in the press just prior to final die try out or just prior to production. Similarly, the tool steel allows the die to be repair welded while the die is mounted in the press or machine. Also, the tool steel allows the die to be finished while the tool steel is in a pre-hardened fully machinable condition having a Rockwell hardness on the C-scale of about 30 to about 38. The tool steel also provides case hardening depths of about three-sixteenths of an inch to about three-eighths of an inch during flame hardening thereby helping to ensure long runs for dies produced utilizing the tool steel. Furthermore, since the tool steel does not contain major amounts of expensive alloying elements, it is a relatively inexpensive material for use in the production of dies and similar items. Finally, the tool steel of the present invention affords significantly improved machinability over the tool steels disclosed in U.S. Pat. Nos. 5,182,079 and 5,055,253.

The tool steel includes up to about 0.85 percent by weight carbon, about 0.95 to about 1.70 percent by weight manganese, about 0.095 to about 0.200 percent by weight sulfur, about 1.0 to about 2.0 percent by weight chromium and about 0.10 to about 0.50 percent by weight nickel. Preferably, the tool steel also includes at least about 0.20 percent by weight copper.

Prior to converting the tool steel into a die, and subsequent to casting the tool steel, it is preferably subjected to a heat treatment schedule. During the heat treatment schedule the tool steel is initially preheated, then austenitized and finally double tempered. During the preheat, preferably the tool steel is heated to an equalization temperature of about 1000°–1200° F. and soaked for about one to three hours for every inch of cross section based upon the heaviest section of the tool steel. While the tool steel is in the furnace at temperature the austenization cycle is initiated. During austenization the tool steel is preferably heated to an equalization temperature of about 1625°–1675° F. for about one to three hours for each inch of cross section based upon the heaviest section of the tool steel and then taken down to an equalization temperature of about 1475°–1525° F. and held at this temperature for about thirty to about ninety minutes for each inch of cross section based upon the heaviest section of the tool steel. The tool steel is then cooled to a temperature of from about 200° F. to about 500° F. During the first temper the tool steel is preferably charged into a furnace having a temperature of about 1100° F. to about 1300° F. and held at temperature for about two to about four hours for each inch of cross section based upon the heaviest section of the tool steel followed by air-cooling to room temperature. During the second temper the tool steel is preferably heated to an equalization temperature of about 1100° F. to about 1300° F. and held at temperature about four to six hours per inch of cross section based upon the heaviest section of the tool steel.

The above heat treatment schedule produces a Rockwell hardness on the C-scale of about 30 to about 38. In this condition, the tool steel may be easily machined or otherwise worked into a tool, die or other item. Subsequent to working, the tool steel may then be flame hardened at a temperature of about 1560° F. to produce a Rockwell hardness on the C-scale of between about 60 and 62 and a case depth of about three-sixteenths of an inch to about three-eighths of an inch.

The foregoing and other features of the invention are hereinafter more fully described and particularly pointed out in the claims, the following detailed description and the annexed drawings setting forth in detail certain illustrative embodiments of the invention, these being indicative, however, of but a few of the various ways in which the principles of the present invention may be employed.

DETAILED DESCRIPTION

The present invention provides a relatively low-alloy tool steel suitable for use in producing any one of a variety of items such as, for example, tools, dies, knives, punches and molds. However, the tool steel is particularly well suited for use in producing dies. The tool steel is particularly well suited to dies subject to demanding applications such as the dies employed by the automotive industry.

Figure 1:
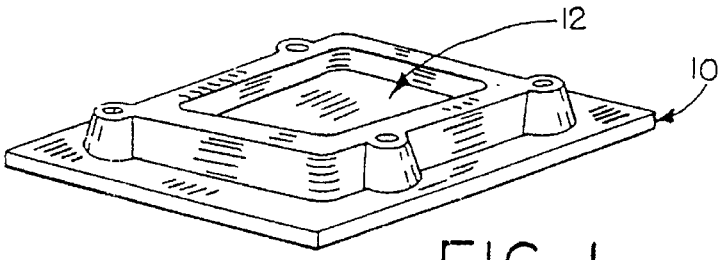
FIG. 1 is a perspective view of a die made in accordance with the principles of the present invention.
Figure 2:
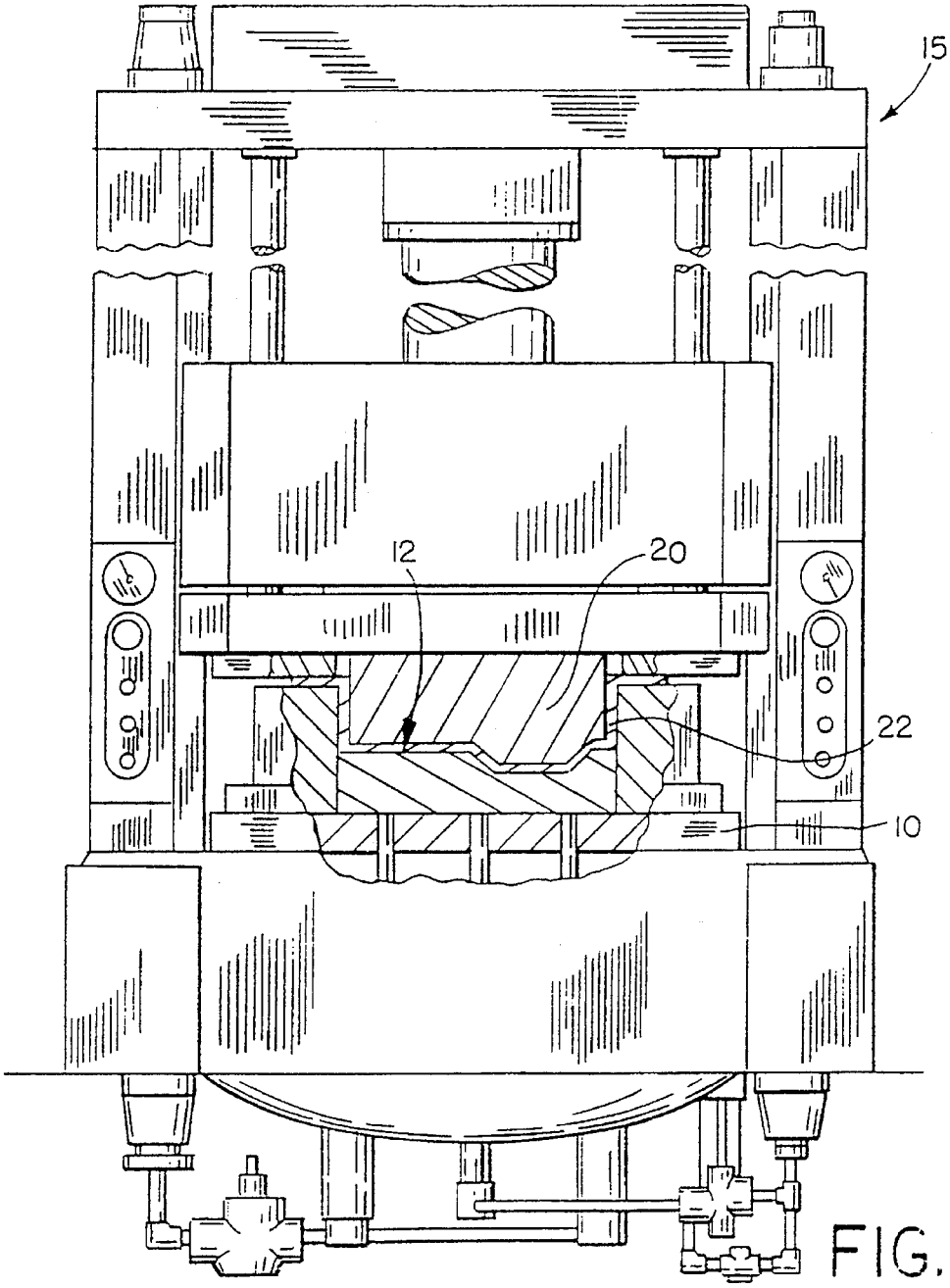
FIG. 2 is a schematic partial cross section of the die of FIG. 1 mounted in a press.

Shown in FIG. 1 is a die 10 produced utilizing applicant's tool steel. For the purposes of this specification, and the claims below, a die is defined as a tool that imparts shape to solid, molten or powdered metal because of the shape of the tool itself. Such dies are used in various press operations including blanking, drawing, forming, in die casting and in forming green powder and metallurgy compacts. Die 10 is preferably machined or ground to its final shape while the die 10 is in a pre-hardened or soft condition. Once the die 10 has been worked to its final configuration, the working surface 12 of the die 10 is then flame hardened. Illustrated in FIG. 2 is a press 15 in which die 10 is mounted. As a result of the application of pressure imparted by the press 15 upon the die 10 and the punch 20, a workpiece 22 is formed into a finished or semifinished part.

As is well-known in the art, tool steels are metallic compositions that predominately contain iron and are alloyed with various other elements such as, for example, carbon, manganese, chromium, nickel and molybdenum. Tool steels are generally characterized by high hardness and resistance to abrasion.

The tool steel of the present invention is produced utilizing conventional melting practices to provide a tool steel having up to about 0.85 percent by weight carbon, about 0.095 to about 1.70 percent by weight manganese, about 1.0 to about 2.0 percent by weight chromium and about 0.10 to about 0.50 percent by weight nickel. In order to enhance machinability, the tool steel includes a very high level of sulfur, from about 0.095 to about 0.200 percent by weight sulfur. Quite unexpectedly, applicant has found that this high level of sulfur can be used to significantly improve machinability without the development of undesirable properties such as poor surface quality, poor weldability, brittleness, cracking, poor strength, etc.

Preferably, the tool steel includes copper and is killed or deoxidized utilizing primarily, but not exclusively, silicon. Also, preferably the amount of phosphorus contained in the tool steel is limited. In another preferred embodiment the tool steel includes about 0.4 to about 0.8 percent by weight carbon, about 0.105 to about 1.65 percent by weight manganese, up to about 0.050 percent by weight phosphorus, about 0.105 to about 0.190 percent by weight sulfur, from about 0.30 to about 0.90 percent by weight silicon, about 1.10 to about 1.90 percent by weight chromium, about 0.15 to about 0.40 percent by weight nickel and from about 0.20 to about 0.60 percent by weight copper. More preferably, the tool steel comprises about 0.50 to about 0.65 percent by weight carbon, about 1.15 to about 1.60 percent by weight manganese, up to about 0.050 percent by weight phosphorus, about 0.110 to about 0.175 percent by weight sulfur, about 0.40 to about 0.85 percent by weight silicon, about 1.15 to about 1.85 percent by weight chromium, about 0.15 to about 0.40 percent by weight nickel, and from about 0.20 to about 0.55 percent by weight copper.

In a further preferred embodiment of the invention the tool steel comprises about 0.52 to about 0.68 percent by weight carbon, about 1.25 to about 1.55 percent by weight manganese, up to about 0.030 percent by weight phosphorus, about 0.110 to about 0.165 percent by weight sulfur, about 0.50 to about 0.80 percent by weight silicon, about 1.20 to about 1.75 percent by weight chromium, about 0.15 to about 0.35 percent by weight nickel, and from about 0.25 to about 0.50 percent by weight copper.

Preferably, like phosphorus, other residual elements contained in the tool steel are controlled such that iron accounts for at least about 90.0 percent by weight of the tool steel. More preferably, iron accounts for at least about 92.0 percent by weight of the tool steel. More particularly, preferably, the amount of residual molybdenum contained in the steel is limited to about 0.30 percent by weight, and more preferably it is limited to about 0.20 percent by weight of the tool steel. Likewise, preferably the vanadium contained in the tool steel is limited to about 0.020 percent by weight, and more preferably, it is limited to about 0.010 percent by weight of the tool steel. Additionally, preferably the cobalt (Co) contained in the tool steel is limited to about 0.05 percent by weight of the tool steel. Additionally, preferably the tungsten (W) contained in the tool steel is limited to about 0.03 percent by weight of the tool steel. Also, preferably the titanium (Ti) contained in the tool steel is limited to about 0.001 percent by weight of the tool steel. Additionally, preferably the nitrogen (N) contained in the tool steel is limited to about 0.01 percent by weight of the tool steel. The presence of excess amounts of titanium, vanadium, nitrogen, molybdenum, tungsten, cobalt and other hardening agents may cause excessive undesirable hardening characteristics in the tool steel.

The tool steel preferably includes aluminum (Al). Preferably, the tool steel comprises from about 0.03 percent to about 0.30 percent by weight aluminum. More preferably, the tool steel comprises from about 0.05 percent to about 0.25 percent by weight aluminum.

The tool steel is preferably cast at a temperature of between about 2825° F. and about 2860° F. Preferably, the molds in which the tool steel is cast are stripped at about 600° F. and the tool steel is then allowed to air-cool to room temperature. Any one of a variety of steel melting techniques and/or processes may be utilized to produce the tool steel. For example, an electric furnace, basic oxygen furnace or an induction furnace may be utilized to produce the molten tool steel. Likewise, any one of a variety of casting techniques may be employed such as top pour molds, bottom pour molds, sand molds, metal molds or a continuous caster may even be employed. Further, the tool steel may be cast into any one of a variety of shapes such as, for example, blooms, billets, ingots, bars or into the pattern of a die. Preferably, the tool steel is cast to its near final desired shape. However, if necessary, subsequent to stripping the tool steel may be heated to a suitable temperature and hot-worked into alternative shapes.

Subsequent to stripping and cooling, the tool steel is then preferably subjected to a heat treatment schedule. The heat treatment schedule softens the tool steel thereby facilitating the cutting, machining, or other operations that may be utilized to convert the as cast tool steel into a die or similar item. More particularly, the heat treatment schedule refines the grain structure of the as cast tool steel placing it in a pre-hardened condition suitable for machining, grinding and flame hardening with substantially no distortion.

The heat treatment schedule includes preheating, austenization and a double temper. Preheating is performed by heating the tool steel to an equalization temperature of about 1000° F. to about 1200° F., and preferably about 1100° F. where it is held at temperature for about one to about three hours for every inch of cross section based upon the thickest or heaviest section of the tool steel, and preferably about two hours per inch of such cross section. As used herein this specification and the claims below, the term "equalization" refers to a substantially equal, homogeneous or uniform temperature throughout the piece or section of tool steel.

Immediately after the preheat, while still in the furnace, austenization is performed. Austenization is initially performed at an equalization temperature of about 1625° F. to about 1675° F., and preferably about 1650° F. The tool steel is held at this equalization temperature for about one to about three hours per inch of cross section based upon the thickest section of the tool steel, and preferably two hours for each inch of such cross section. The tool steel is then taken down to an equalization temperature of about 1475° F. to about 1525° F., and preferably about 1500° F. and held at this equalization temperature for about thirty to ninety minutes per inch of cross section based upon the thickest section of the tool steel. The tool steel is then air-cooled to an equalization temperature of from about 200° F. to about 500° F., and preferably from about 250° F. to about 450° F. Depending on the type of furnace utilized, a nitrogen purge or circulation fans may be utilized to promote cooling.

The first of the tempers is performed at an equalization temperature of about 1100° F. to about 1300° F., and preferably about 1200° F. for a period of between about two and about four hours per inch of cross section based upon the thickest section of the tool steel, and preferably about three hours per inch of such cross section. The tool steel is then air-cooled to ambient or room temperature. The second temper is performed at an equalization temperature of about 1100° F. to about 1300° F., and preferably about 1200° F. for a period of between about four and six hours per inch of cross section and preferably about five hours per inch of such cross section. Preferably, during each of the tempers the tool steel is charged into a furnace or oven which has been preheated to temperature.

Subsequent to heat treatment, the tool steel is in a pre-hardened condition and it generally displays a Rockwell hardness of about 30 to about 38 on the C-scale. Preferably, the tool steel does not display a Rockwell hardness in excess of 39 on the C-scale. In this pre-hardened condition, the tool steel is relatively easy to machine, grind or otherwise process into a die such as die 10 shown in FIG. 1. Since the tool steel is relatively soft, it is unlikely to chip or break during such processing. As used herein this specification, and the claims below, "Rockwell" on the "C-scale" refers to hardness values obtained using a standard sphero-conical diamond penetrator.

Once the tool steel has been fully processed and finished into a die 10, the die 10 may then be post-hardened in a furnace, oven or similar heating device. Preferably, the die 10 is flame hardened and air-cooled along the working surface 12 in order to produce a Rockwell hardness on the C-scale of about 60 to about 62, with virtually no distortion. During flame hardening, case depths of between about three-sixteenths of an inch to about three-eighths of an inch may be attained on the working surface 12. Preferably, flame hardening is accomplished by heating the surface of the tool steel to a temperature of between about 1530° F. to about 1600° F., and preferably about 1560° F., followed by air-cooling. This flame hardening step may be carried out while the die 10 is mounted in the press 15. Similarly, the die 10 may be repair welded in the press 15 without any preheating. Applicant has found that when repairing cracks in castings such as dies made from the tool steel of the present invention, subsequent to welding and filling the crack, the repaired weld area should be lightly peened prior to flame hardening.

In order to further illustrate the invention, the following example is provided below.

EXAMPLE I

In an induction furnace a tool steel melt is formed having a composition comprising 0.60 percent by weight carbon, 0.65 percent by weight silicon, 1.4 percent by weight manganese, 0.01 percent by weight phosphorus, 0.120 percent by weight sulfur, 1.50 percent by weight chromium, 0.25 percent by weight nickel, 0.40 percent by weight copper, 0.09 percent by weight aluminum and residual amounts of nitrogen, titanium, cobalt, tungsten, vanadium and molybdenum. The tool steel melt is cast at about 2845° F. and poured into molds which form 20 pound castings having a thickest or heaviest cross section of about one inch. The molds are stripped at a temperature of about 600° F. and then the castings are air-cooled to room temperature. Preheating is performed by heating the castings to an equalization temperature of about 1100° F. where they are held at temperature for about two hours. Immediately after preheating, while the castings are still in the furnace, the austenization cycle is initiated. Austenization is initially performed at an equalization temperature of about 1650° F. The castings are then held at this equalization temperature for about two hours. The castings are then taken down to an equalization temperature of about 1500° F. and held at this equalization temperature for about one hour. The castings are then air-cooled and quenched in a nitrogen purge. The first of the tempers is performed at an equalization temperature of about 1200° F. for a period of about two hours and then the castings are air-cooled to room temperature. The second temper is performed at an equalization temperature of about 1200° F. for a period of about five hours. The casting are then air-cooled to room temperature. Subsequent to heat treatment the castings display a Rockwell hardness of about 33 on the C-scale. The castings are then machined into dies and flame hardened. During flame hardening the work surface of the castings are heated to a temperature of about 1560° F. followed by air cooling. Subsequent to flame hardening the dies display a Rockwell hardness of about 62 on the C-scale.

It will be appreciated that although the above description has been primarily focused upon dies, the tool steel of the present invention is also well suited for use in producing various other items such as punches, knives, blades and any other variety of items where the properties of a tool steel are desired.

Although the invention has been shown and described with respect to preferred embodiments, it is obvious that equivalent alterations and modifications will occur to others skilled in the art upon reading and understanding the specification. The present invention includes all such equivalent alterations and modifications, and is limited only by the scope of the following claims.

What is claimed:

1. A method of producing a tool or die comprising the steps of:

(A) providing a section of metal comprising iron (Fe), up to about 0.85 percent by weight carbon (C), about 0.095 to about 1.70 percent by weight manganese (Mn), about 0.095 to about 0.200 percent by weight sulfur (S), about 1 to about 2 percent by weight chromium (Cr) and about 0.10 to about 0.50 percent by weight nickel (Ni);

(B) austenitizing such metal; and (C) tempering such metal.

2. A method as set forth in claim 1 including the step of:

(D) tempering such metal for a second time.

3. A method as set forth in claim 1 wherein prior to said step (B) such metal is preheated.

4. A method as set forth in claim 1 wherein during said austenitizing step (B) such metal is initially heated to an equalization temperature of from about 1625° F. to about 1675° F. for a period of from about one to about three hours for about every inch of cross section measured at the thickest portion of such metal, then such metal is heated to a temperature of from about 1475° F. to about 1525° F. for from about thirty to about ninety minutes for about every inch of cross section measured at the thickest portion of such metal.

5. A method as set forth in claim 4 wherein during said austenization step (B) such metal is heated to an equalization temperature of about 1650° F. for a period of about one hour for about each inch of cross section at the thickest portion of such metal and then such metal is heated to an equalization temperature of about 1500° F. for about one hour for each inch of cross section measured at the thickest portion of such metal.

6. A method as set forth in claim 10 wherein subsequent to said step B and prior to said step C such metal is cooled to an equalization temperature of from about 200° F. to about 500° F.

7. A method as set forth in claim 6 wherein such metal is cooled to an equalization temperature of from about 250° F. to about 400° F.

8. A method as set forth in claim 1 wherein during said tempering step (C) such metal is heated to an equalization temperature of from about 1100° F. to about 1300° F. for about from two to about four hours for about each inch of cross section measured at the thickest portion of such metal.

9. A method as set forth in claim 1 wherein during said tempering step (C) such metal is heated to an equalization temperature of about 1200° F. for about three hours for about every inch of cross section measured at the heaviest portion of such metal and subsequent to said tempering step (C) such metal is air-cooled to room temperature.

10. A method as set forth in claim 2 wherein during said tempering step (D) such metal is heated to an equalization temperature of from about 1100° F. to about 1300° F. for a period of about four to six hours for about each inch of cross section measured at the thickest portion of such metal.

11. A method as set forth in claim 2 wherein during said tempering step (D) such metal is heated to an equalization temperature of about 1200° F. for a period of about five hours for about every inch of cross section measured at the thickest portion of such metal and then air-cooled to room temperature.

12. A method as set forth in claim 3 wherein during said step of preheating such metal is heated to an equalization temperature of from about 1000° F. to about 1200° F. for from about one to about three hours for about every inch of cross section measured at the heaviest portion of such metal.

13. A method as set forth in claim 12 wherein during said step of preheating such metal is heated to an equalization temperature of about 1100° F. for about two hours for about every inch of cross section measured at the heaviest portion of such metal.

14. A method as set forth in claim 2 including the steps of:

(E) machining such metal so as to structurally form such die or tool; and (F) flame hardening such metal.

15. A method as set forth in claim 1 including the steps of:

(D) machining such section of metal so as to structurally form such die or tool; and (E) flame hardening such section of metal; said flame hardening step including the steps of heating the surface of such section of metal to a temperature of from about 1530° F. to about 1600° F. followed by air-cooling.

* * * * *